United States Patent [19]

O'Donoghue

[11] Patent Number: 4,718,773

[45] Date of Patent: Jan. 12, 1988

[54] CLOCK

[75] Inventor: Colin N. O'Donoghue, New Barnet, England

[73] Assignee: The Brampton Clock Company Limited, London, England

[21] Appl. No.: 737,289

[22] Filed: May 23, 1985

[30] Foreign Application Priority Data

Jul. 18, 1984 [GB] United Kingdom ..... 8418290
Sep. 19, 1984 [GB] United Kingdom ..... 8423661

[51] Int. Cl.[4] ..... G04B 37/00

[52] U.S. Cl. ..... 368/276; 368/232; 368/236

[58] Field of Search ..... 368/310, 314, 285, 276, 368/239, 236, 237, 232

[56] References Cited

U.S. PATENT DOCUMENTS 1,847,800 3/1932 Weil ..... 368/228
3,177,646 4/1965 Ernest et al. ..... 368/228
4,505,596 3/1985 Barbieri et al. ..... 368/314
4,506,993 3/1985 Brown ..... 368/314

FOREIGN PATENT DOCUMENTS 2483096 11/1981 France ..... 368/300
338720 3/1936 Italy ..... 368/314
343319 1/1960 Switzerland ..... 368/232
877680 9/1961 United Kingdom ..... 368/232

*Primary Examiner*—Bernard Roskoski
*Attorney, Agent, or Firm*—Arnold, White & Durkee

[57] ABSTRACT

A clock has a movement with protruding nested drive shafts. A housing member has a wall and a ridge which is forwardly offset from the wall. A planar dial rests against the ridge and is formed with an aperture in register with the aperture of the wall with the nested shafts extending through the apertures. A securing device engages the front of the dial, extends through the aligned apertures and engages a fixed member of the movement thereby holding the dial against the ridge.

4 Claims, 2 Drawing Figures

CLOCK

This invention relates to clocks.

According to this invention there is provided a clock comprising a clock movement with protruding nested drive shafts, a housing member having a wall formed with an aperture, a planar dial which rests against the wall and which is formed with an aperture in register with the aperture of the wall, the nested shafts extending through the apertures, and a securing device which engages the front face of the dial, extends through the aligned apertures, and engages a fixed member of the movement thereby holding the dial against the wall.

Preferably the wall has a ridge which is forwardly offset from the wall, said dial resting and being held against said ridge.

Preferably, the fixing member is a nut having a male thread which engages a female thread of the fixed member of the movement; the fixed member of the movement is preferably its case.

Preferably the clock has a reversible dial; by a reversible dial is meant a dial which is printed on both sides and which may be assembled into the clock with either of its two faces facing outwards so as to be visible.

Figure 1:
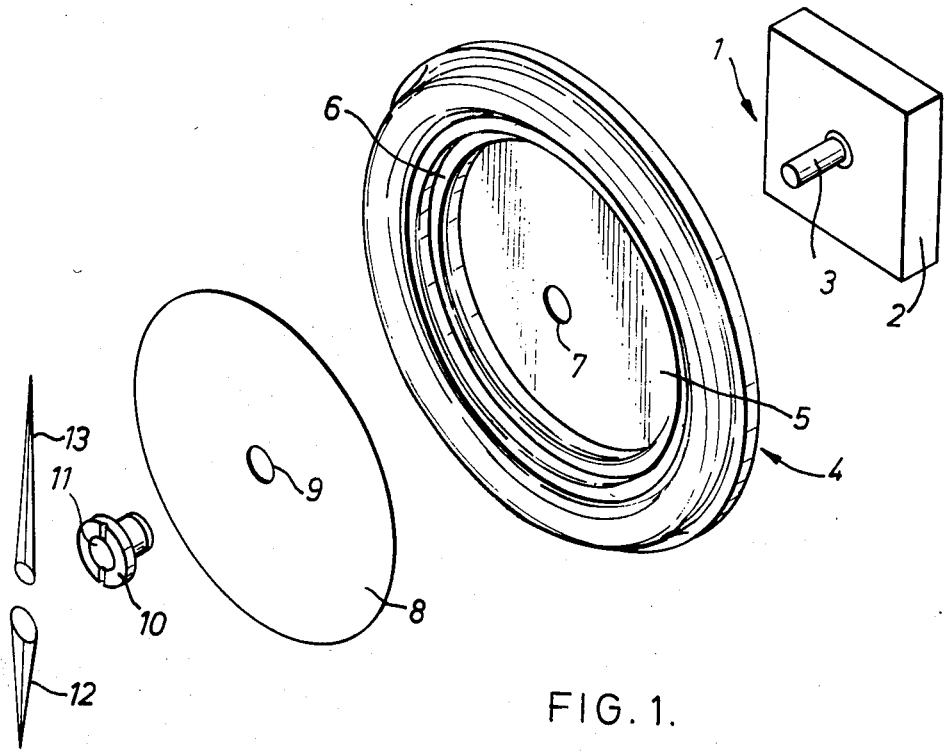
Figure 2:
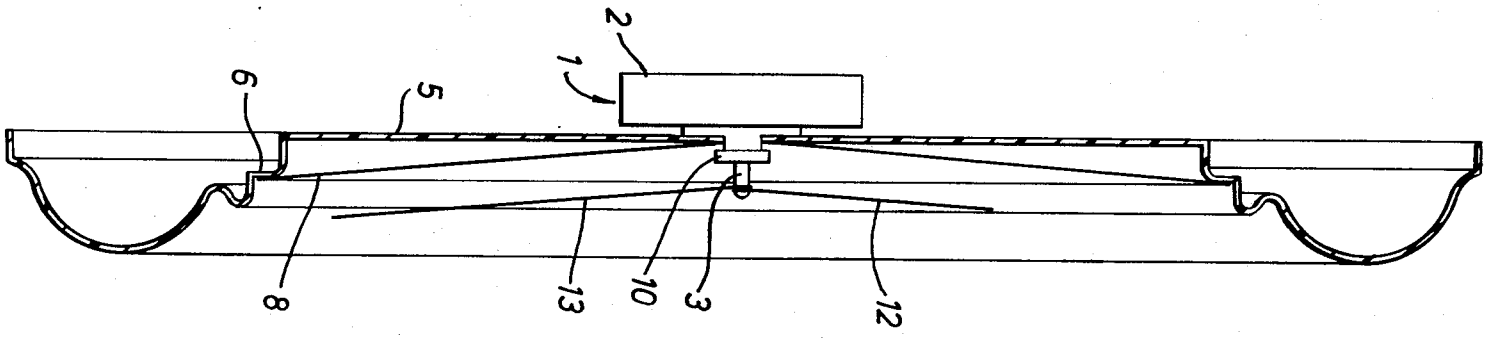

An embodiment of this invention will now be described, by way of example only, with reference to the accompanying drawings of which:

FIG. 1 is an exploded view of a clock in accordance with this invention; and FIG. 2 is a section through an assembled clock in accordance with this invention.

Referring to the Figures, the clock has a movement 1 having a casing 2 from which nested concentric shafts 3 protrude. A clock case 4 in the form of a plastics member has a flat wall 5 surrounded by a forwardly offset flat ridge 6; the wall 5 has a central aperture 7. A circular cardboard dial 8 (which may be printed on both sides) has an aperture 9 at its centre aligned with the aperture 7 of the wall 5 and its periphery engages the circular ridge.

The movement 1 rests against the rear of the wall 5 with its nested shafts 3 protruding through the aligned apertures 7 and 9 and a nut 10, which has a central core 11 through which the shafts 3 pass, is screwed into a female thread in the casing 2 thereby clamping the dial 8 against the centre of the wall 5 so that its periphery is urged against the ridge 6; this tensions the cardboard dial 8 and helps to prevent the dial 8 from curling. Hour and minute hands 12 and 13 are mounted on the concentric shafts 3 in conventional manner.

To change the dial 8 or to reverse it, the hands 12 and 13 are first removed and the nut 10 is then unscrewed. The dial 8 may then be replaced or reversed and the nut 10 re-fitted over the nested shafts 3 and tightened. Thereafter, the hands 12 and 13 may be re-attached to the nested shafts 3.

A reversible dial may be provided in other clocks.

I claim:

1. A clock comprising a clock movement with a fixed member and protruding nested drive shafts, the housing member having a wall formed with an aperture; a planar dial which rests against the wall and which is formed with an aperture in register with the aperture of the wall, the nested shafts extending through the apertures, and a securing device which engages the front face of the dial, extends through the aligned apertures, and engages a fixed member of the movment thereby holding the dial against the wall, a portion of said dial surrounding the aperture in the dial and being positioned against the wall, the wall having a ridge which is forwardly offset from the remainder of the wall, a periphery of said dial resting and being held against said ridge thereby tensioning the dial so as to form a concave surface.

2. A clock as claimed in claim 1 wherein the fixing member is a nut having a male thread which engages a female thread of the fixed member of the movement.

3. A clock as claimed in claim 1 wherein the fixed member of the movement is its case.

4. A clock as claimed in claim 1 wherein the dial is reversible.

* * * * *

UNITED STATES PATENT AND TRADEMARK OFFICE

CERTIFICATE OF CORRECTION

PATENT NO. : 4,718,773

DATED : January 12, 1988

INVENTOR(S) : Colin N. O'Donoghue

It is certified that error appears in the above-identified patent and that said Letters Patent are hereby corrected as shown below:

In Column 2, line 3, "core" should be --bore--.

Signed and Sealed this

Second Day of August, 1988

*Attest:*

*Attesting Officer*

DONALD J. QUIGG

*Commissioner of Patents and Trademarks*